US010321246B2

(12) United States Patent
Flaig et al.

(10) Patent No.: US 10,321,246 B2
(45) Date of Patent: Jun. 11, 2019

(54) HEARING INSTRUMENT WITH POWER SUPPLY UNIT, AND POWER SUPPLY UNIT FOR A HEARING INSTRUMENT

(71) Applicant: SIVANTOS PTE. LTD., Singapore (SG)

(72) Inventors: Uwe Flaig, Feucht (DE); Anand Ganapathy, Singapore (SG); Stefanie Beyfuss, Erlangen (DE); Uwe Rass, Nuremberg (DE); Frank Naumann, Bubenreuth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/455,462

(22) Filed: Mar. 10, 2017

(65) Prior Publication Data

US 2017/0188162 A1 Jun. 29, 2017

Related U.S. Application Data

(63) Continuation of application No. PCT/EP2015/070776, filed on Sep. 10, 2015.

(30) Foreign Application Priority Data

Sep. 10, 2014 (DE) ..... 10 2014 218 053

(51) Int. Cl.
*H04R 25/00* (2006.01)

(52) U.S. Cl.
CPC ..... *H04R 25/602* (2013.01); *H04R 25/305* (2013.01); *H04R 2225/021* (2013.01); *H04R 2225/31* (2013.01); *H04R 2225/33* (2013.01); *H04R 2225/61* (2013.01)

(58) Field of Classification Search
CPC ..... H04R 25/602; H04R 25/305; H04R 2225/021; H04R 2225/31; H04R 2225/33; H04R 2225/61
See application file for complete search history.

(56) References Cited

U.S. PATENT DOCUMENTS 3,475,566 A 10/1969 Bauer
5,995,636 A 11/1999 Topholm
(Continued)

FOREIGN PATENT DOCUMENTS

CN 1161001 A 10/1997
DE 9415594 U1 3/1996
(Continued)

*Primary Examiner* — Tuan D Nguyen
(74) *Attorney, Agent, or Firm* — Laurence A. Greenberg; Werner H. Stemer; Ralph E. Locher

(57) ABSTRACT

A hearing instrument has a hearing device rear housing, at least one microphone, a receiver, an earpiece connection or a soundc tube, an earpiece, a power supply unit, and a signal processing unit. The power supply unit includes a rechargeable power supply and an actuating and control device. The hearing instrument further includes a switching device that is configured to assume at least two switching states, and the actuating and control device is configured to actuate a switched-off state of the hearing instrument depending on the switching state of the switching device. There is also described a corresponding power supply unit for a hearing instrument.

22 Claims, 6 Drawing Sheets

(56) References Cited

U.S. PATENT DOCUMENTS

| | | | | |
|---|---|---|---|---|
| 6,410,997 | B1 * | 6/2002 | Sjursen | H01M 2/1044 307/130 |
| 7,522,739 | B2 | 4/2009 | Rass et al. | |
| 7,790,702 | B2 | 9/2010 | Hori et al. | |
| 8,023,678 | B2 | 9/2011 | Fischer | |
| 2004/0081328 | A1 | 4/2004 | Leedom et al. | |
| 2008/0232625 | A1 * | 9/2008 | Koch | H04R 25/00 381/323 |
| 2010/0260367 | A1 | 10/2010 | Hasler et al. | |
| 2012/0314892 | A1 | 12/2012 | Cheng et al. | |
| 2014/0321682 | A1 * | 10/2014 | Kofod-Hansen | H04R 25/305 381/315 |
| 2015/0289068 | A1 * | 10/2015 | Sundberg | H04R 25/608 381/323 |
| 2015/0295216 | A1 * | 10/2015 | Okuno | H01M 2/1653 320/128 |

FOREIGN PATENT DOCUMENTS

| | | | |
|---|---|---|---|
| DE | 19903090 | U1 | 8/2000 |
| DE | 102004023049 | A1 | 12/2005 |
| DE | 102007029375 | B3 | 11/2008 |
| DE | 202008016880 | U1 | 4/2009 |
| DE | 102011004966 | A1 | 3/2012 |

* cited by examiner

HEARING INSTRUMENT WITH POWER SUPPLY UNIT, AND POWER SUPPLY UNIT FOR A HEARING INSTRUMENT

CROSS-REFERENCE TO RELATED APPLICATION

This is a continuation application, under 35 U.S.C. § 120, of copending international application No. PCT/EP2015/070776, filed Sep. 10, 2015, which designated the United States; this application also claims the priority, under 35 U.S.C. § 119, of German patent application No. DE 10 2014 218 053.8, filed Sep. 10, 2014; the prior applications are herewith incorporated by reference in their entirety.

BACKGROUND OF THE INVENTION

Field of the Invention

The present invention relates to a hearing instrument including a power supply unit. In addition, the present invention relates to a power supply unit for a hearing instrument.

Hearing instruments may be designed as hearing aids. A hearing aid is used for providing a hearing-impaired person with acoustic ambient signals, which are processed and amplified in order to compensate for or to treat the respective hearing impairment. In principle, it comprises one or multiple input transducers, a signal processing device including an amplification device or an amplifier, and an output transducer. The input transducer is generally a sound receiver, for example, a microphone, and/or an electromagnetic receiver, for example, an induction coil. The output transducer is generally implemented as an electroacoustic converter, for example, a miniature loudspeaker, or as an electromechanical converter, for example, a bone conduction earpiece. It is also referred to as an earpiece or receiver. The output transducer generates output signals, which are routed to the ear of the patient and which generate auditory perception in the patient. The amplifier is generally integrated into the signal processing device. Currently, power is supplied to the hearing device via a battery which may be inserted into the hearing aid housing. The essential electronic components of a hearing aid are generally arranged on a printed circuit board acting as a circuit substrate, or connected thereto.

In addition to being designed as a hearing aid used to compensate for diminished hearing ability, which is usually referred to as hearing impairment, hearing instruments may also be designed as so-called tinnitus maskers. Tinnitus maskers are used for treating tinnitus patients. They generate acoustic output signals which may aid in reducing the perception of disturbing tinnitus or other ear noises, which acoustic output signals being a function of the respective hearing impairment and, depending on the operating principle, also being a function of ambient noise. The term "hearing instrument" is to be understood below also to mean tinnitus maskers and other such devices.

Hearing aids are known in various basic housing configurations. In the case of in-the-ear (ITE) hearing aids, a housing, which contains all functional components including a microphone and receiver, is worn mostly in the auditory canal. Completely-in-canal (CIC) hearing aids are similar to the ITE hearing aids, but are worn completely in the auditory canal. In the case of behind-the-ear (BTE) hearing devices, a housing including components such as a battery and a signal processing device is worn behind the ear, and a flexible sound tube, also referred to as a tube, routes the acoustic output signals of a receiver from the housing to the auditory canal. Receiver-in-canal behind-the-ear (RIC-BTE) hearing aids are similar to the BTE hearing aids, but the receiver is worn in the auditory canal, and instead of a sound tube which routes acoustic signals to an earpiece, a flexible cable, also referred to as an earpiece tube or earpiece connecting means, routes electrical signals to a receiver which is attached to the front of the cable.

In addition to excellent acoustic properties which are fostered, for example, via high-quality input transducers, output transducers, and a good signal processing device, aesthetic and cosmetic demands are increasingly being made on modern hearing instruments. In particular, hearing instruments should be as inconspicuous as possible when worn. Furthermore, there is often the risk of hearing instruments being damaged due to the entry of liquids, for example, sweat. Another requirement for a modern hearing instrument relates to the ease of operation of the devices, which are now equipped with many features. Ease of operation also means that hearing instruments should require little maintenance, for example, with respect to dealing with the power supply of the hearing instrument.

SUMMARY OF THE INVENTION

It is accordingly an object of the invention to provide a hearing instrument which overcomes the above-mentioned and other disadvantages of the heretofore-known devices and methods of this general type and which provides for a hearing instrument that requires little maintenance in comparison to conventional hearing instruments and which is well protected, in particular from sweat.

With the foregoing and other objects in view there is provided, in accordance with the invention, a hearing instrument, comprising:

a hearing instrument body housing;

at least one microphone and a receiver mounted on or in said housing;

an earpiece and an earpiece connector or a sound tube;

a signal processing unit connected to said at least one microphone and said receiver;

a power supply unit including a rechargeable power supply and a control and monitoring device;

a switching device configured to assume at least two switching states;

said control and monitoring device controlling a switched-off state of the hearing instrument as a function of a switching state of said switching device;

said switching device including a first part, which is arranged on a first component of the hearing instrument, and a second part which is arranged on a second component of the hearing instrument, and wherein the switching state of said switching device is changeable via a relative movement between the first component of the hearing instrument and the second component of the hearing instrument;

a sealing device and an activatable limiting device;

wherein, in an activated state, the relative movement between the first component of the hearing instrument and the second component of the hearing instrument is limited by said limiting device, and the switching device is sealed in an open switching state due to a limitation of the relative movement by said limiting device and by said sealing device; and wherein said switching device is sealed in a closed switching state by said sealing device.

With the above and other objects in view there is also provided, in accordance with the invention, a hearing instrument, comprising:

a hearing instrument body housing, at least one microphone, a receiver, an earpiece connector or a sound tube, an earpiece, a power supply unit, and a signal processing unit;

a switching device configured to assume at least two switching states;

said power supply unit including a rechargeable power supply and a control and monitoring device, said control and monitoring device controlling a switched-off state of the hearing instrument as a function of the switching state of said switching device.

In other words, the objects of the invention are achieved by the hearing instruments, as summarized above, and also by a power supply unit as claimed.

One basic concept of the present invention is a hearing instrument including a power supply unit, comprising a hearing aid body housing, at least one microphone, a receiver, an earpiece connecting means or a sound tube, an earpiece, a power supply unit, and a signal processing unit. The power supply unit includes a rechargeable energy supply means and a control and monitoring device; the hearing instrument includes a switching device, wherein the switching device is designed to assume at least two switching states. The control and monitoring device is designed to control a switched-off state of the hearing instrument, as a function of the switching state of the switching device.

To achieve the object according to the present invention, this basic concept of the present invention includes a power supply unit having a rechargeable power supply and a control and monitoring device, and a switching device, in addition to components of a hearing instrument which are known per se, for example, a hearing aid body housing, at least one microphone, a receiver, an earpiece connecting means or a sound tube, an earpiece, and a signal processing unit. The switching device may assume at least two switching states, wherein the control and monitoring device may put the hearing instrument into a switched-off state, as a function of the switching state of the switching device. The maintenance of the hearing instrument may be simplified through the use of a rechargeable power supply, for example, a rechargeable battery, a rechargeable battery pack, or a capacitor, since the power supply may remain in the hearing instrument for charging. After they have delivered their electric power, commonly used non-rechargeable batteries must be replaced by new ones. For this purpose, a battery door which is integrated into the hearing aid body housing is normally opened, whereby dirt is able to enter the hearing instrument. Battery doors usually also perform the function of connecting the battery to, or disconnecting it from, the electronics of the hearing instrument. The hearing instrument which is operated by the rechargeable power supply has a control and monitoring device, which may also be referred to as a power management means or power management module, and it has the switching device, the state of which may be queried via the control and monitoring device. If the switching device is in a certain predefinable state, the control and monitoring device switches the hearing instrument into a switched-off state, which is characterized by no power consumption or very low power consumption by the hearing instrument. The signal processing unit may include all electronic functions, except possibly functions for power management.

It is conceivable that the rechargeable power supply of the hearing instrument is chargeable in the switched-off state.

For example, in the switched-off state, the hearing instrument may be placed into a charger and charged via an inductive charging method which is in particular controlled or regulated by the control and monitoring device.

Preferably, the control and monitoring device is designed for controlling at least one connection between the power supply and the signal processing unit, as a function of the switching state of the switching device.

"Control" may in particular mean breaking the connection between the power supply and the signal processing unit, so that no power consumption occurs.

In one advantageous refinement, the power supply unit is permanently arrangeable or arranged inside the hearing aid body housing for protection from contamination.

Here, "permanent" should be understood to mean the duration of multiple or many charge or operating cycles, or the service life or operating life of the power supply. A permanent duration is to distinguish from batteries which are disposed of when they are "empty." A great advantage of rechargeable power supply over disposable batteries is that they do not have to be removed after discharging, and that a battery door is therefore also not required. Furthermore, terminals of the power supply may be laid inside the hearing aid body housing, or if necessary, only small-area contact surfaces may be accessible from the outside, thereby greatly reducing the risk of contamination of the interior of the hearing aid body housing.

In another advantageous embodiment, the switching device includes a means from the group including a pushbutton, a switch, a wired connection, and a switch which is influenceable by a magnetic field.

A pushbutton may, for example, include a type of flip-flop, so that an actuation of the pushbutton may be stored. Thus, pushing and releasing the pushbutton may define a first switching state, and pushing and releasing the pushbutton a second time may define a second switching state. As a result, the control and monitoring device may control the switched-off state of the hearing instrument, as a function of these switching states of the switching device. The switching device may be designed as a wired connection, via which a circuit may be closed or opened. A switch which may be influenced by a magnetic field is, for example, a reed switch or reed contact which is known per se, in which contact tongues made mostly of an iron-nickel alloy are magnetically actuated and thus establish a connection.

The switching device is particularly advantageously operable by a user. Via this feature, a user, for example, a hearing aid wearer, may actuate the switching device and put the hearing instrument into the switched-off state if the user, for example, does not need the hearing instrument.

It is provided that the switching device includes an openable door, wherein the surface of the door is adapted to the shape of the hearing aid body housing, in the closed state. That is, the shape of the door conforms to the housing.

Users of hearing instruments are accustomed to selecting a function of the hearing instrument, for example, by opening a battery door of a commercially available hearing instrument. Even if a battery door as such is no longer necessary due to one of the hearing instruments according to the present invention, it may, however, be advantageous to provide a battery door-like switching device, i.e., a switching device having an openable door, in order to maintain accustomed operation by opening and closing this door. A door having a surface adapted to the shape of the hearing aid body housing, i.e., a surface which is essentially adapted to the shape of the hearing aid body housing, is favorable and may help to avoid injuries and damage.

Another advantageous embodiment provides that, in the open state, the switching device has a switching state in which at least one line connection is broken (i.e., disconnected). A broken line connection is advantageous, since a high resistance may thereby be achieved, which facilitates a switched-off state having low power consumption.

In an alternative embodiment, the switching device is also designed for opening and closing at least one connection between the power supply and the signal processing unit.

An effective switched-off state may be achieved via a switching device, for example, a wire bridge which is able to break an electrical connection, for example, a connection to a positive operating voltage, between the power supply, for example, a rechargeable battery, and the signal processing unit, for example, an electronic circuit.

It is conceivable that the switching device is designed for opening and closing three or four connections, wherein two connections are designed for connecting the power supply to the signal processing unit and/or to the control and monitoring device.

In the case of three electrical connections, two electrical connections may relate to a positive and a negative operating voltage; the third electrical connection may, for example, be routed to a contact of the control and monitoring device, which controls the switched-off state of the hearing instrument. In the case of four electrical connections, two electrical connections may again relate to a positive and a negative operating voltage; the third and fourth electrical connections may, for example, connect two contacts of the control and monitoring device and thus control the switched-off state of the hearing instrument.

In one advantageous refinement of the present invention, the switching device includes a first component and a second component, wherein the first component of the switching device is arranged on a first component of the hearing instrument, and wherein the second component of the switching device is arranged on a second component of the hearing instrument. The switching state of the switching device may be changed via a relative movement between the first component of the hearing instrument and the second component of the hearing instrument.

In this embodiment of the present invention, the switching device is made up of two components or parts which are arranged on different objects or components of the hearing instrument, wherein the components may move relative to one other. For example, the switching device may be a contact pin which is insertable into a spring terminal, or a plug connector which is closable or openable via the relative movement. The components of the switching device may, for example, be arranged on the power supply unit, on or in the hearing aid body housing, or on or in a battery door-like door. The relative movement may be a translational movement or a rotational or tilting movement.

In an additional advantageous embodiment, the hearing instrument includes at least one sealing device. Via this sealing device, the switching device is sealable, at least in a closed switching state.

Via sealing rings or sealing caps containing silicone, the switching device may, for example, be protected from dirt, moisture, and sweat. If the switching device is designed having two parts, and if the closing process of the switching device is based on a relative movement of the two parts, the sealing effect, for example, during a closing process, may take place via a form-locking contact of the sealing ring with a part of the switching device.

In another advantageous embodiment, the hearing instrument includes at least one sealing device and an activatable limiting device. The relative movement between the first component of the hearing instrument and the second component of the hearing instrument is limited by the activated limiting device, and the switching device is sealed in an open switching state by the sealing device.

A limiting device limits a relative movement between the two components of the hearing instrument without impairing the switching action of the switching device. Via the feature of this embodiment, it is achieved that the sealing means even in the open switching state i.e., if the displacement of the relative movement is generally greater than in a closed switching state, the sealing action of the sealing device still exists. A limiting device may, for example, be a mechanical stop. The limiting device limits the relative movement only in an activated state. In an inactivated state, the relative movement of two components of the hearing instrument may therefore be greater, and the sealing action of the sealing device does not necessarily have to be maintained. Three states of the hearing instrument may thereby result: a first, in which the switching device is in a closed state, and the switching device is sealed by the sealing device; a second, in which the switching device is in an open state, and the switching device is sealed by the sealing device; and a third, in which the switching device is in an open state, and the switching device is not sealed by the sealing device.

It has proven to be advantageous if the power supply includes a rechargeable battery which contains lithium.

Rechargeable batteries containing lithium include, for example, lithium-ion rechargeable batteries and lithium-polymer rechargeable batteries. These batteries have a high energy density and a high charging efficiency; therefore, they are highly suitable for hearing instruments. It is disadvantageous that they are sensitive, for example, with respect to operation, in particular the discharge currents and the discharge cycle, and with respect to charging, in particular the end-of-charge voltage and amperage of the charging currents, and are therefore preferably monitored in these operating modes, for example, via a control and monitoring device. In particular, if a hearing instrument is not used for a longer period of time, for example, during storage before sale, one of the previously described hearing instruments according to the present invention is highly advantageous, since deep discharge, and thus degradation or even destruction of the rechargeable battery, may be prevented by putting the hearing instrument into the switched-off state.

A further basic idea of the present invention is a power supply unit for a hearing instrument, comprising a rechargeable power supply and a control and monitoring device, wherein the power supply unit, along with a hearing aid body housing, at least one microphone, a receiver, an earpiece connecting means or a sound tube, an earpiece, a signal processing unit, and a switching device, forms one of the previously described hearing instruments.

This basic idea of the present invention describes a power supply unit which is arrangeable in a hearing instrument, and which includes a rechargeable power supply, for example, a lithium-ion rechargeable battery, and which includes a control and monitoring device which is able to control a switched-off state of the hearing instrument by reading out a state of a switching device. Additional embodiments of this basic idea result from analogous assignments of features from the previously described embodiment variants of the hearing instruments according to the present invention.

Other features which are considered as characteristic for the invention are set forth in the appended claims.

Although the invention is illustrated and described herein as embodied in a hearing instrument with a power supply unit, and a power supply unit for a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
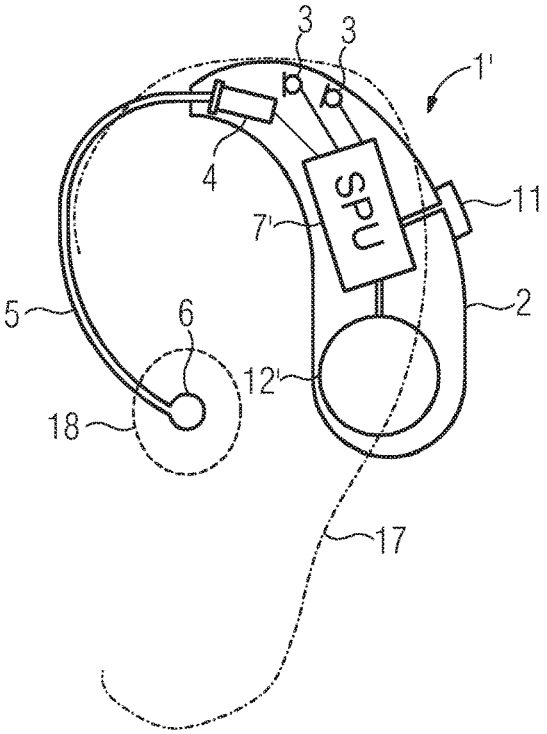
FIG 1 Prior Art
FIG. 1 is a schematic side view of a hearing aid according to the prior art.

Referring now to the figures of the drawing in detail and first, particularly, to FIG. 1 thereof, there is shown a behind-the ear (BTE) hearing aid 1' according to the prior art. The hearing aid 1' includes a hearing aid body housing 2 to be worn behind an auricle 17 of a hearing aid wearer, i.e., a user. Two microphones 3, a battery 12', and a receiver 4 are arranged in the hearing aid body housing 2, in addition to electronic components which are combined to form a signal processing unit (SPU) 7'. The acoustic signal generated by the receiver 4 is routed through a sound tube 5 to an earpiece 6, which is inserted into the auditory canal 18 of the hearing aid wearer. A monitoring element 11 is arranged on the hearing aid body housing 2, which is able to influence the signal processing unit 7'.

Figure 2:
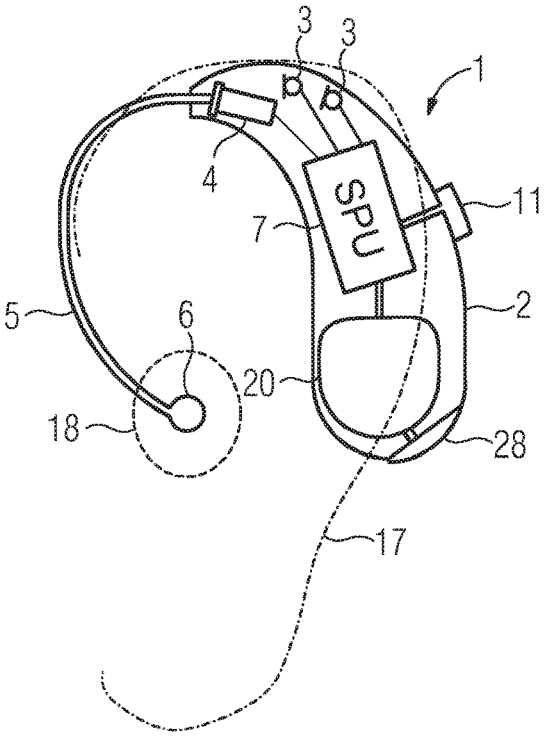
FIG. 2 is a schematic side view of a hearing aid according to the present invention.

FIG. 2 depicts, schematically and by way of example, a plan view of a hearing means 1 according to the present invention, here, a behind-the ear hearing aid. It includes a hearing aid body housing 2 to be worn behind an auricle 17 of a hearing aid wearer, two microphones 3, a receiver 4, a sound tube 5, an earpiece 6, a power supply unit 20, or power supply, and a signal processing unit (SPU) 7 which includes electronic components. The acoustic signal generated by the receiver 4 is routed through the sound tube 5 to the earpiece 6, which is inserted into an auditory canal 18 of the hearing aid wearer. A monitoring element 11 is arranged on the hearing aid body housing 2, which is able to influence the signal processing unit 7. The power supply unit 20 includes a rechargeable power supply which is not depicted, here, a lithium-polymer rechargeable battery, and a control and monitoring device. The hearing instrument 1 furthermore includes a switching device, also referred to as a switch, which includes a door 28. The switching device, or switch, is designed to assume at least two switching states, and the control and monitoring device is configured to control a switched-off state of the hearing instrument 1 as a function of the switching state of the switching device. The power supply unit 20 is permanently arranged inside the hearing aid body housing 2 for protection from contamination. In the closed state, the surface of the openable door 28 of the switching device is adapted to the shape of the hearing aid body housing 2.

Figure 3:
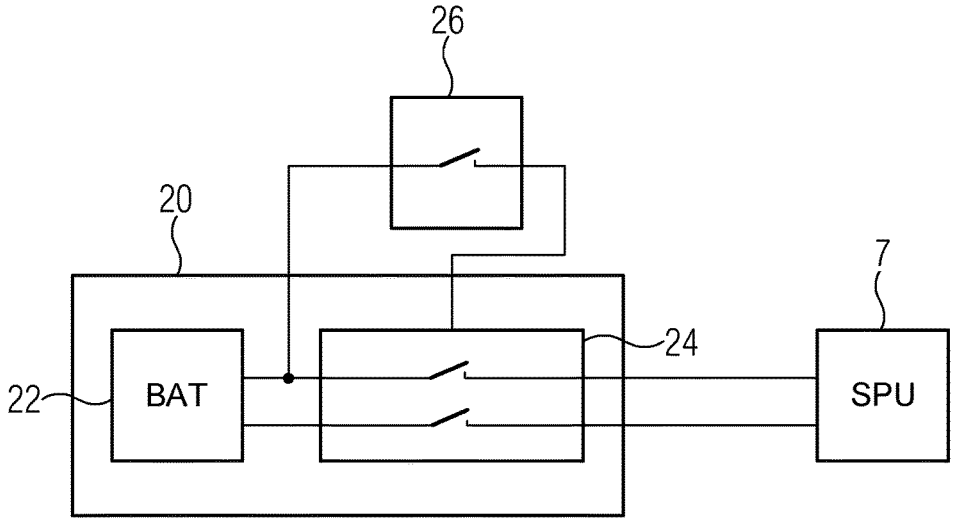
FIG. 3 is a schematic view of an exemplary power supply unit and a switching device for controlling the power supply unit.

FIG. 3 shows, schematically and by way of example, a power supply unit 20 and a switching device 26 for controlling the power supply unit 20. For its part, the power supply unit 20 includes a power supply (BAT) 22, for example, a rechargeable battery, and a control and monitoring device 24, for example, an electronic circuit. In this exemplary embodiment, the switching device 26, here, a switch or a normally open switch, may assume two states: an open or high-resistance state, and a closed or conductive state. The control and monitoring device 24 is configured to control a switched-off state of a hearing instrument, here, schematically indicated by a signal processing unit (SPU) 7, as a consumer of electric power of the hearing instrument, as a function of the switching state of the switching device 26. In this exemplary embodiment, the control is carried out in that, in the case of detection of the open state of the switching device 26, supply lines, for example, a positive and negative supply voltage, from the power supply 22 to the signal processing unit 7, are broken via the control and monitoring device 24, indicated by two open switches in the control and monitoring device 24. By opening the electrical connections, the signal processing unit 7 is at zero current, and the hearing instrument is in a switched-off state.

Figure 4:
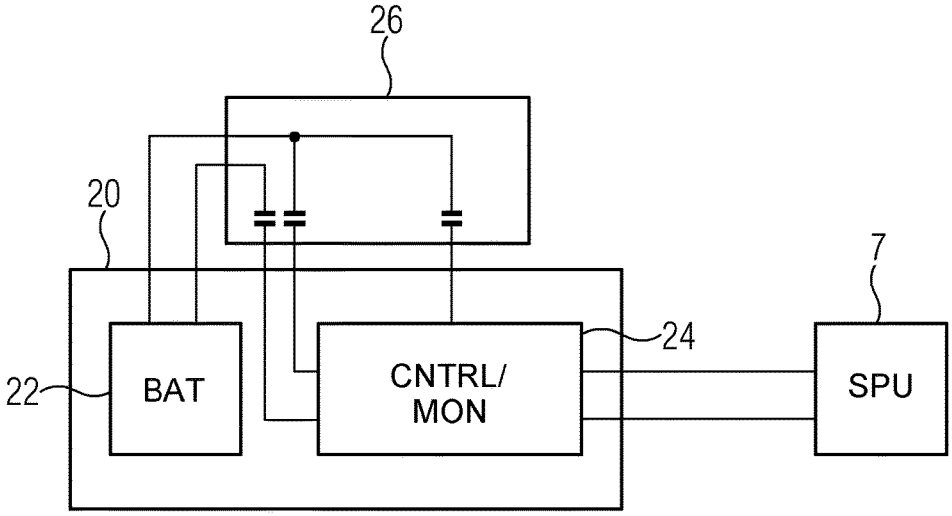
FIG. 4 is a schematic view of an exemplary switching device for controlling a power supply unit, which switching device controls the connections between a power supply and a control and monitoring device.

FIG. 4 shows, schematically and by way of example, a switching device 26 for controlling a power supply unit 20, which again includes a power supply 22 and a control and monitoring device 24, for example, an electronic circuit. The switching device 26 includes three switches which control connections between the power supply 22 and the control and monitoring device (CNTRL/MON) 24. In FIG. 4, the switches are depicted in a nonconductive or open state. Supply lines, for example, a positive and a negative supply voltage, from the power supply 22 to the control and monitoring device 24, are broken, as well as a control line, indicated by a signal which is present at the top of the control and monitoring device 24. Due to this zero-current state of the control and monitoring device 24, a signal processing unit 7, as an essential current sink of a hearing instrument, is also at zero current and is in a switched-off state.

Figure 5:
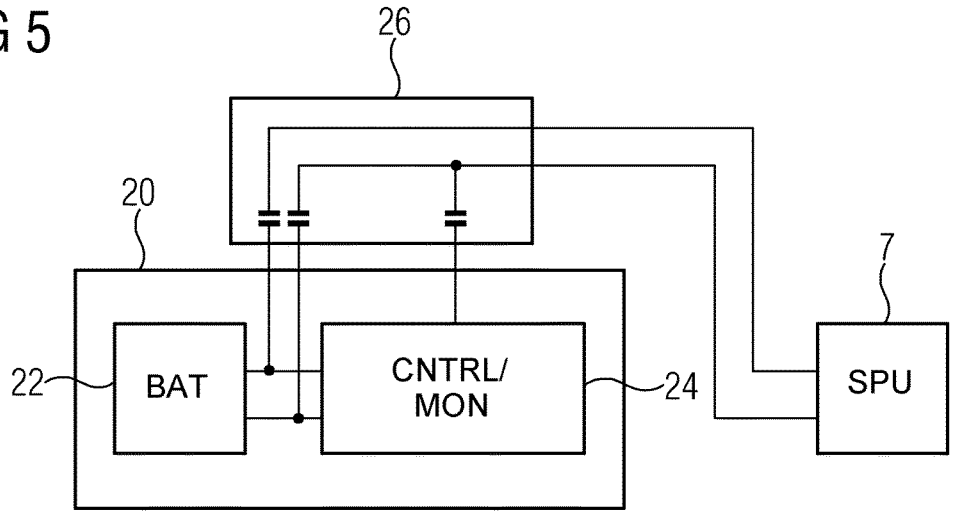
FIG. 5 is a schematic view of an exemplary switching device for controlling a power supply unit, which switching device controls connections between a power supply and a signal processing unit.

FIG. 5 schematically depicts another example of a switching device 26 for controlling a power supply unit 20. The power supply unit 20 includes a rechargeable power supply 22, for example, a rechargeable battery, and a control and monitoring device 24 (CNTRL/MON). Via the switching device 26, electrical connections between the power supply 22 and a signal processing unit 7 may be controlled, i.e., opened or closed. In the depicted state, the signal processing unit 7, in particular the voltage supply lines, are disconnected from the power supply 22; therefore, the hearing instrument is in a switched-off state. Simultaneously, a control line, indicated by a signal which is present at the top of the control and monitoring device 24, has a high resistance, whereby the control and monitoring device 24 itself may enter a switched-off state in which the control and monitoring device 24 draws no electric power or very little electric power.

It is also conceivable that the rechargeable power supply 22 of the hearing instrument is chargeable in the switched-off state. For example, in the switched-off state, the hearing instrument may be placed into a charger and charged via an inductive charging method which is controlled in particular via the control and monitoring device 24.

Figure 6:
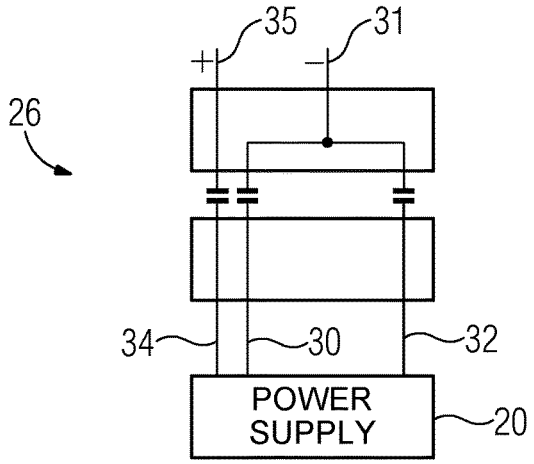
FIG. 6 is a schematic view of an exemplary switching device having three ports in an open state.
Figure 7:
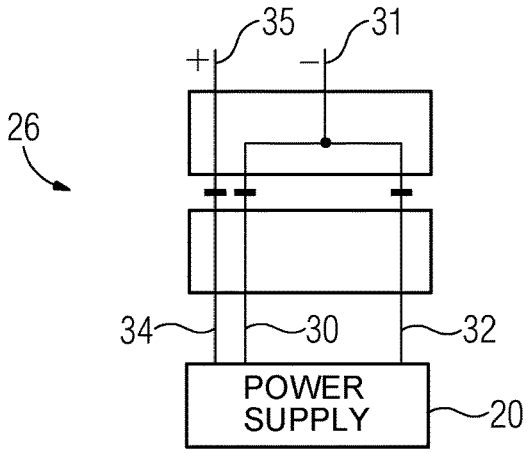
FIG. 7 is a schematic view of an exemplary switching device having three ports in a conductive state.

FIG. 6 and FIG. 7 show, schematically and by way of example, a switching device 26 having three ports in an open state and in a conductive state. Via the switching device, 26 a terminal 35 of a positive operating voltage of a power supply is connectable to a terminal 34 of a positive operating voltage of a power supply unit 20, and a terminal 31 of a negative operating voltage of the power supply is connectable to a terminal 30 of a negative operating voltage of the power supply unit 20. Simultaneously, the terminal 31 of the negative operating voltage of the power supply is connectable to a monitoring terminal 32 of the power supply unit 20. In a closed state of the switching device 26, the negative operating voltage of the power supply is present at the monitoring terminal 32; in an open state, the monitoring terminal 32 has a high resistance. The power supply unit 20, in particular a control and monitoring device of the power supply unit 20, may control a switched-off state of a hearing instrument as a function of the switching state of the switching device 26.

Figure 8:
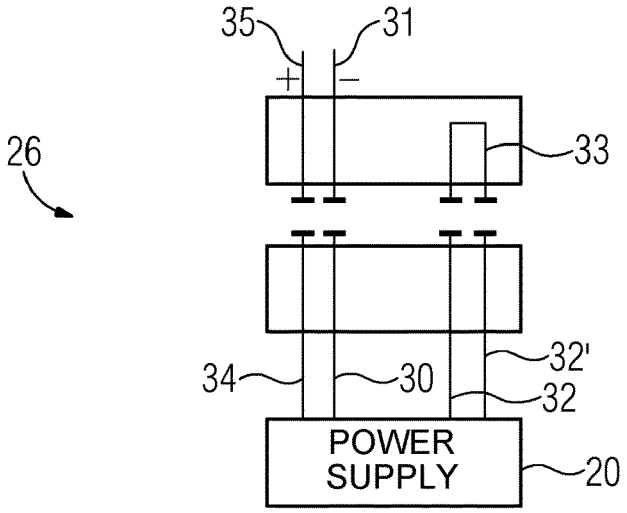
FIG. 8 is a schematic view of an exemplary switching device having four ports in an open state.
Figure 9:
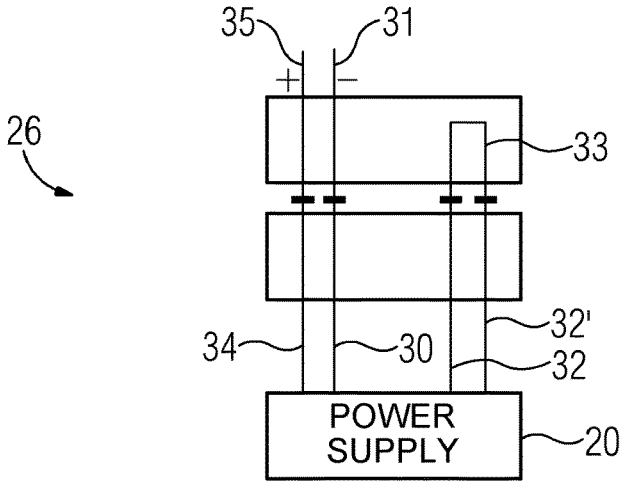
FIG. 9 is a schematic view of an exemplary switching device having four ports in a conductive state.

FIG. 8 and FIG. 9 show, schematically and by way of example, a switching device 26 having four ports in an open state and in a conductive state. Via the switching device 26, a terminal 35 of a positive operating voltage of a power supply is connectable to a terminal 34 of a positive operating voltage power supply unit 20, and a terminal 31 of a negative operating voltage of the power supply is connectable to a terminal 30 of a negative operating voltage of the power supply unit 20. Simultaneously, a monitoring terminal 32 of the power supply unit 20 is connectable to another monitoring terminal 32' of the power supply unit 20 via a wire bridge 33. In a closed state of the switching device 26, the monitoring terminal 32 is thus short-circuited to the other monitoring terminal 32'; in an open state, the monitoring terminal 32 and the other monitoring terminal have a high resistance. The power supply unit 20, in particular a control and monitoring device of the power supply unit 20, may control a switched-off state of a hearing instrument as a function of the switching state of the switching device 26.

Figure 10:
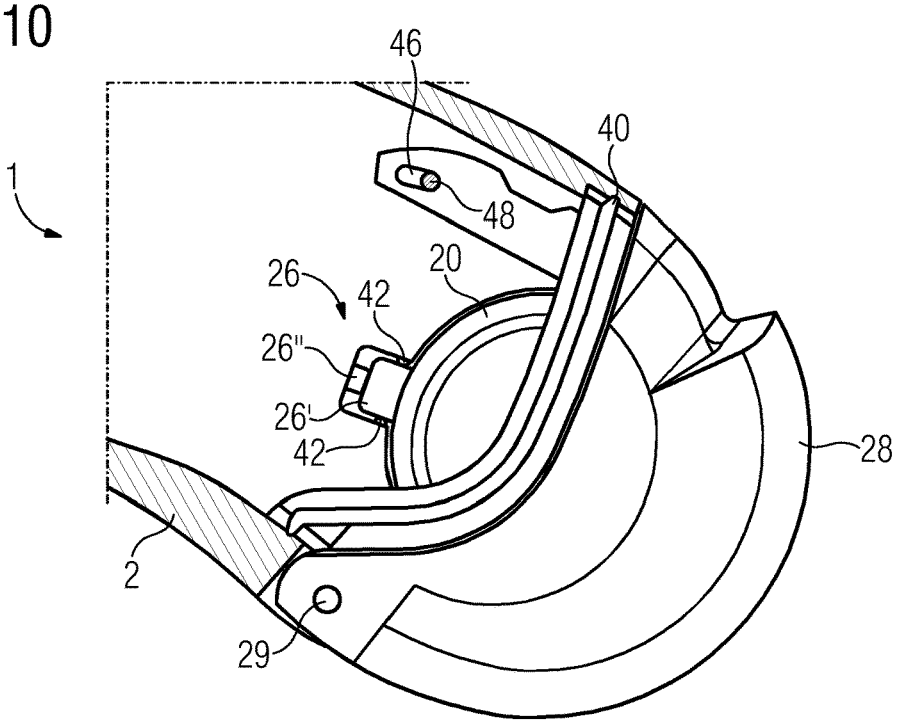
FIG. 10 is a partial diagrammatic view of an exemplary hearing instrument according to the present invention having a switching device in a closed, sealed state.
Figure 11:
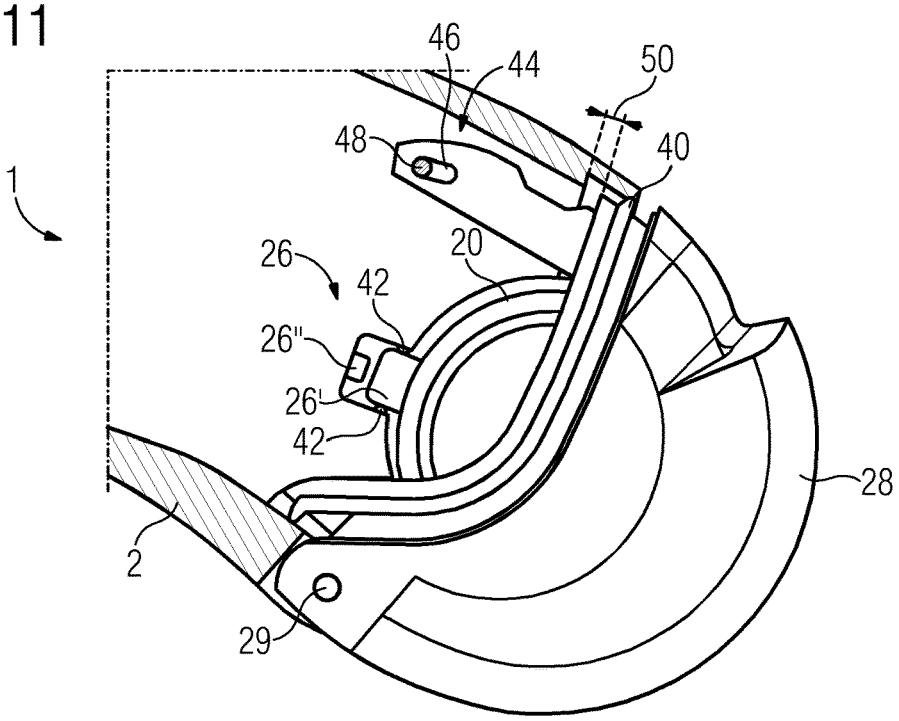
FIG. 11 is a partial diagrammatic view of an exemplary hearing instrument according to the present invention having a switching device in an open, sealed state.
Figure 12:
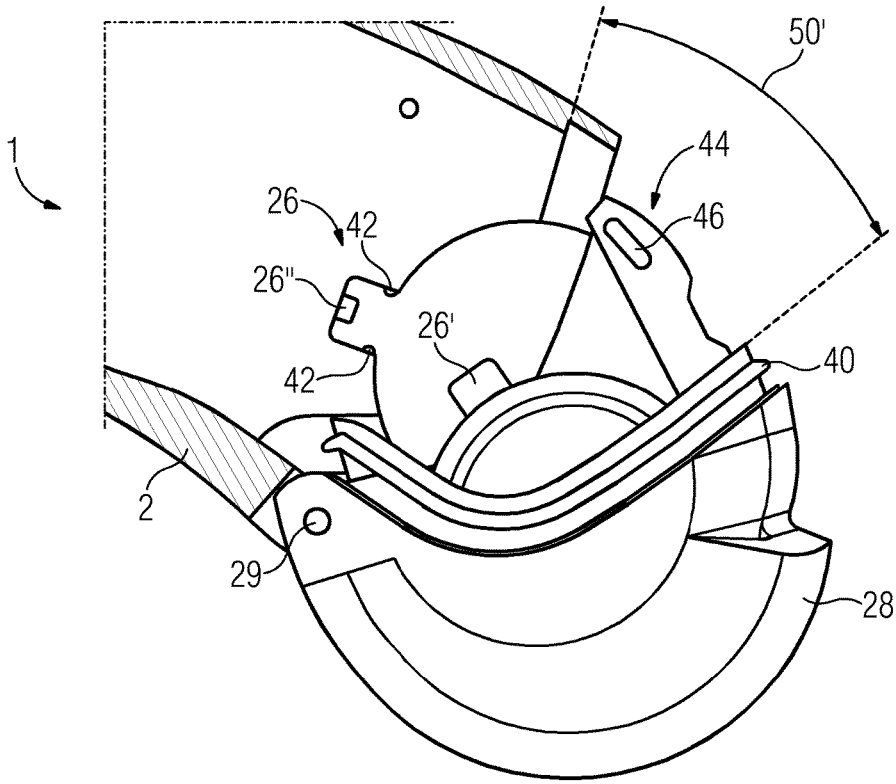
FIG. 12 is a partial diagrammatic view of an exemplary hearing instrument according to the present invention having a switching device in an open, non-sealed state.

FIG. 10, FIG. 11, and FIG. 12 respectively show, schematically and by way of example, a hearing aid 1 according to the present invention, here, a behind-the-ear hearing aid, having a switching device 26 in a closed, sealed state, in an open, sealed state, and in an open, non-sealed state. The hearing aid 1 includes, inter alia, a hearing aid body housing 2 and a power supply unit 20 which is connected to a door 28. The power supply unit 20 includes a rechargeable power supply which is not depicted, for example, a lithium-ion rechargeable battery, and a control and monitoring device which is not depicted. Although the power supply unit 20 does not need to be accessible during normal use by a hearing instrument user, the door 28 is designed similarly to a battery door of a conventional hearing aid, in order to provide the user with accustomed operation of the hearing instrument. In particular, the door 28 includes an axle 29 via which a relative movement of the door 28 may be carried out. In this exemplary embodiment, the switching device 26 is made up of two components or parts, which are arranged on different objects or components of the hearing instrument 1. The first component 26' (i.e., part) of the switching device 26, here, contact pins, is arranged on the power supply unit 20; the second component 26" (i.e., part) of the switching device 26, here, a spring terminal, is arranged on the hearing aid body housing 2. In the state depicted in FIG. 10, the door 28 is closed and the surface of the door 28 is adapted to the shape of the hearing aid body housing 2, in the closed state. The hearing instrument 1 has two sealing devices via which the switching device 26 is sealed in the closed switching state. The first sealing device 40 is a sealing lip made of rubber, which is arranged on the door 28 and which fits snugly around the circumference on the inner side of the hearing aid body housing 2, in the closed state of the door 28. The second sealing device 42 is a sealing ring containing silicone, which is arranged in the interior of the hearing aid body housing 2, and which seals a portion of the power supply unit 20, on the end of which the first portion 26' of the switching device 26 is arranged, around the circumference in a form-locking manner. A limiting device 44 in the form of a tongue, which is arranged on the door 28, engages the hearing aid body housing 2. In the closed state of the hearing instrument 1, an elongated hole 46 of the limiting device 44, and a pin 48 which is arranged on the hearing aid body housing 2 and engages with the elongated hole 46, have no essential function for achieving the object according to the present invention.

FIG. 11 shows hearing instrument 1 from FIG. 10 in an open, sealed state. The respective components having associated reference numerals in the two figures are identical. In this state, the door 28 is opened slightly. The opening, which results from a relative movement 50, is sufficient to transfer the switching device 26 from the closed state to the open state, which is wherein the first component 26' of the switching device 26 is not in contact with the second component 26" of the switching device 26. The switching device 26 is thus operable, controllable, or influenceable by a user. The relative movement 50 is limited by the limiting device 44, since the pin 48 on one end of the elongated hole 46 of the limiting device 44 blocks further opening of the door 28. In this state, the switching device 26 is open and the door 28 is also open; however, the hearing instrument 1 is still in a sealed state since, due to the limitation of the relative movement 50 by the limiting device 44, the first sealing device 40 and the second sealing device 42 fulfill the same sealing function as in the closed state. In other words, even in the open state of the switching device 26, the power supply unit 20 and in particular the switching device 26 are protected from dirt, moisture, and sweat, wherein the switching action of the switching device 26 is not impaired by the limiting device 44. In contrast to conventional hearing instruments, which must be opened to replace empty batteries, this state may be maintained over many charging cycles of the power supply unit 20.

FIG. 12 depicts the hearing instrument 1 of FIG. 10 and FIG. 11 in an open, non-sealed state. The respective components having associated reference numerals in the three figures are identical. In an activated state, the limiting device 44 limits a relative movement of the door 28. In an inactivated state, which, for example, may be induced by removing the pin 48 from FIG. 11, the relative movement 50' of the door 28 may be greater than the relative movement 50 from FIG. 11. In this state, there is no sealing action via the first sealing device 40 or via the second sealing device 42. It is conceivable that this state, in which the hearing instrument 1 is not protected from dirt and moisture, is used, for example, for programming the hearing instrument by a hearing aid acoustician or for replacing a defective power supply unit 20. Transferring the limiting device 44 from an active state to an inactive state may be limited to specialists via corresponding design measures, such as the requirement for a special tool, so that during daily use of the hearing instrument 1, only the states depicted in FIG. 10 and FIG. 11 occur, in which the hearing instrument is sealed.

In summary, other embodiments and advantages of the present invention are described. Hearing instruments having a power supply unit integrated into the instrument, for example, in the form of a so-called Li-ion power module, provide, for example, advantages for maintenance, since the power supply unit is embedded in a protected manner in the housing of the hearing instrument. Such a power supply unit advantageously has at least two operating modes: an active mode in which the hearing instrument is supplied by electrical energy, and a switched-off mode in which the power supply unit is more or less switched off and no current flows. The switched-off mode is in particular important for shelf life, in order to prevent a deep discharge of a rechargeable battery of the power supply unit. A user of the hearing instrument should be able to switch between these two operating modes. The present invention describes multiple alternatives of how control of the modes could be advantageously carried out.

In one embodiment of the present invention, the supply unit, also referred to as the power module, includes a rechargeable power supply, for example, a rechargeable battery, and a control and monitoring device which may be designed as an integrated electric circuit, for example, in the form of a power management IC. The power management IC may have a dedicated pin, the state of which decides, for example, as a function of a voltage value or a resistance value, whether the power supply unit and thus the hearing instrument is operated in the active mode or in the switched-off mode. In one exemplary embodiment, the power supply unit is placed inside a housing, similarly to a known battery holder, and a switching device has the form of a known battery door or a battery lid. Since the power supply unit does not have to be replaced like a battery, it may be sealed, apart from possible contacts, and is thus protected from sweat, moisture, and other contamination. If the switching device in the form of a battery door is opened slightly, there is no contact between the power supply unit and contact holders of the hearing instrument, whereby the dedicated pin of the control and monitoring device is also contactless and puts the power supply unit into the switched-off state. By closing the switching device in the form of a battery door, contacts of the power supply unit are pressed into the contact holders of the hearing instrument, whereby the dedicated pin of the control and monitoring device makes contact, and the power supply unit leaves the switched-off state.

Alternatively, an additional switch or a pushbutton may be arranged on the hearing instrument in order to put the power supply unit into a switched-off state.

The invention claimed is:

1. A hearing instrument, comprising: a hearing instrument body housing; at least one microphone and a receiver mounted on or in said housing; an earpiece and an earpiece connector or a sound tube; a signal processing unit connected to said at least one microphone and said receiver; a power supply unit including a rechargeable power supply and a control and monitoring device; a switching device configured to assume at least two switching states; said control and monitoring device controlling a switched-off state of the hearing instrument as a function of a switching state of said switching device; said switching device including a first part, which is arranged on a first component of the hearing instrument, and a second part which is arranged on a second component of the hearing instrument, and wherein the switching state of said switching device is changeable via a relative movement between the first component of the hearing instrument and the second component of the hearing instrument; a sealing device and an activatable limiting device; wherein, in an activated state, the relative movement between the first component of the hearing instrument and the second component of the hearing instrument is limited by said limiting device, and the switching device is sealed in an open switching state due to a limitation of the relative movement by said limiting device and by said sealing device; and wherein said switching device is sealed in a closed switching state by said sealing device; said switching device configured to control said control and monitoring device.

2. The hearing instrument according to claim 1, wherein an ease of a switchover of said limiting device from the activated state to an inactivated state is defined by given design measures and the switchover is limited to persons with specialist knowledge.

3. The hearing instrument according to claim 1, wherein said rechargeable power supply is chargeable in the switched-off state of the hearing instrument.

4. The hearing instrument according to claim 1, wherein said control and monitoring device is configured to control at least one electrical connection between said power supply and said signal processing unit, as a function of the switching state of the switching device.

5. The hearing instrument according to claim 1, wherein said power supply unit is permanently disposed inside said hearing aid body housing for protection from contamination.

6. The hearing instrument according to claim 1, wherein said switching device comprises a component selected from the group consisting of a pushbutton, a switch, a wired connection, and a switch the is influenceable by a magnetic field.

7. The hearing instrument according to claim 1, wherein said switching device is disposed for user access and operation by a hearing instrument user.

8. The hearing instrument according to claim 1, wherein said switching device includes an openable door, and said door has a surface conforming to a shape of said hearing aid body housing in the closed state.

9. The hearing instrument according to claim 1, wherein, in the open state, said switching device has a switching state in which at least one electrical line connection is disconnected.

10. The hearing instrument according to claim 9, wherein said switching device is configured for also opening and closing at least one electrical connection between said power supply and said signal processing unit.

11. The hearing instrument according to claim 10, wherein the switching device is configured for opening and closing three or four electrical connections, wherein two of said electrical connections connect said power supply to said signal processing unit and/or to said control and monitoring device.

12. A power supply unit for a hearing instrument, the power supply unit comprising:

a rechargeable power supply and a control and monitoring device, wherein the power supply unit, together with a hearing aid body housing, at least one microphone, a receiver, an earpiece connector or a sound tube, an earpiece, a signal processing unit, and a switching device, is configured to form a hearing instrument according to claim 1.

13. A hearing instrument, comprising:

a hearing instrument body housing, at least one microphone, a receiver, an earpiece connector or a sound tube, an earpiece, a power supply unit, and a signal processing unit;

a switching device configured to assume at least two switching states;

said power supply unit including a rechargeable power supply and a control and monitoring device, said control and monitoring device controlling a switched-off state of the hearing instrument as a function of the switching state of said switching device; and said switching device configured to control said control and monitoring device.

14. The hearing instrument according to claim 13, wherein said rechargeable power supply is chargeable in the switched-off state of the hearing instrument.

15. The hearing instrument according to claim 13, wherein said control and monitoring device is configured to control at least one electrical connection between said power supply and said signal processing unit, as a function of the switching state of the switching device.

16. The hearing instrument according to claim 13, wherein said power supply unit is permanently disposed inside said hearing aid body housing for protection from contamination.

17. The hearing instrument according to claim 13, wherein said switching device comprises a component selected from the group consisting of a pushbutton, a switch, a wired connection, and a switch the is influenceable by a magnetic field.

18. The hearing instrument according to claim 13, wherein said switching device is disposed for user access and operation by a hearing instrument user.

19. The hearing instrument according to claim 13, wherein said switching device includes an openable door, and said door has a surface conforming to a shape of said hearing aid body housing in the closed state.

20. The hearing instrument according to claim 13, wherein, in the open state, said switching device has a switching state in which at least one electrical line connection is disconnected.

21. The hearing instrument according to claim 20, wherein said switching device is configured for also opening and closing at least one electrical connection between said power supply and said signal processing unit.

22. The hearing instrument according to claim 21, wherein the switching device is configured for opening and closing three or four electrical connections, wherein two of said electrical connections connect said power supply to said signal processing unit and/or to said control and monitoring device.

* * * * *